United States Patent [19]

King

[11] Patent Number: 4,479,636

[45] Date of Patent: Oct. 30, 1984

[54] FENCE POST CONSTRUCTION

[76] Inventor: Clyde R. King, Rte. 1, Box 170, Crane, Mo. 65633

[21] Appl. No.: 501,524

[22] Filed: Jun. 6, 1983

[51] Int. Cl.[3] ..... E04H 17/02

[52] U.S. Cl. ..... 256/35; 256/22

[58] Field of Search ..... 256/35, 36, DIG. 5, 256/22, 34; 52/154, 153

[56] References Cited

U.S. PATENT DOCUMENTS

| | | | |
|---|---|---|---|
| 264,504 | 9/1882 | Ambrose et al. | 256/DIG. 5 |
| 417,383 | 12/1889 | Christ | 52/154 X |
| 441,781 | 1/1891 | Minnick | 52/154 |
| 528,109 | 10/1894 | Pratt | 256/35 X |
| 1,911,483 | 5/1933 | Thompson | 52/154 X |
| 1,924,834 | 8/1933 | Carrel | 52/154 |
| 1,951,282 | 3/1934 | Hise et al. | 256/35 |
| 4,349,181 | 9/1982 | Asher et al. | 256/35 |

*Primary Examiner*—Andrew V. Kundrat

*Attorney, Agent, or Firm*—Kokjer, Kircher, Bradley, Wharton, Bowman & Johnson

[57] ABSTRACT

An assembly for anchoring a fence comprising a main post having one or more earth anchors each including a pair of upwardly and inwardly inclined pressure plates or vanes to transfer forces from the post into the undisturbed soil adjacent the fence post and to resist upward movement of the post. A brace, preferably of two aligned sections has a large pressure plate affixed thereto and is adjustably clamped to the main post. All pressure plates are installed below the frost line and in relatively close proximity to the undisturbed soil adjacent the installation holes.

4 Claims, 4 Drawing Figures

Fig. 1.
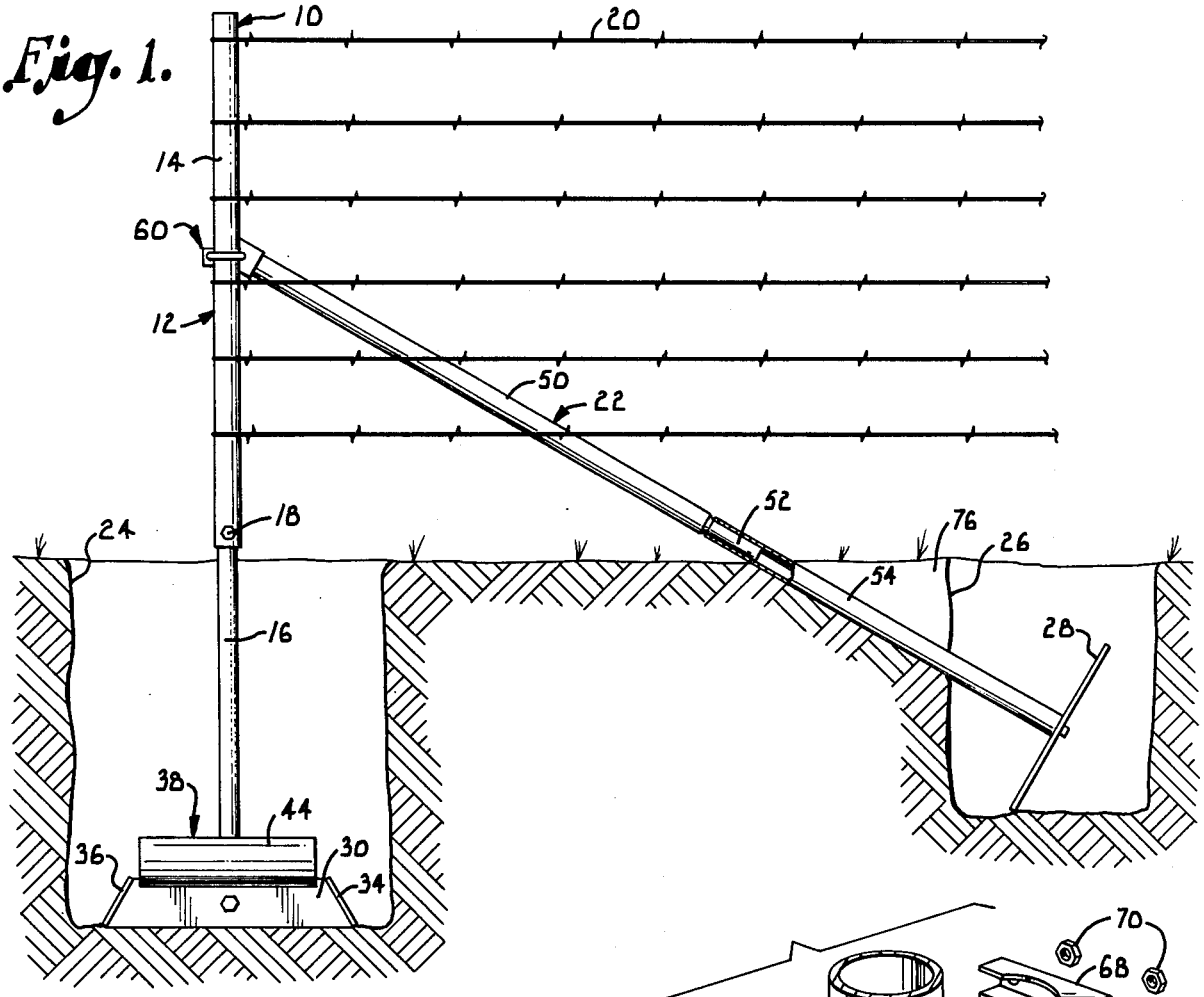
Fig. 2.
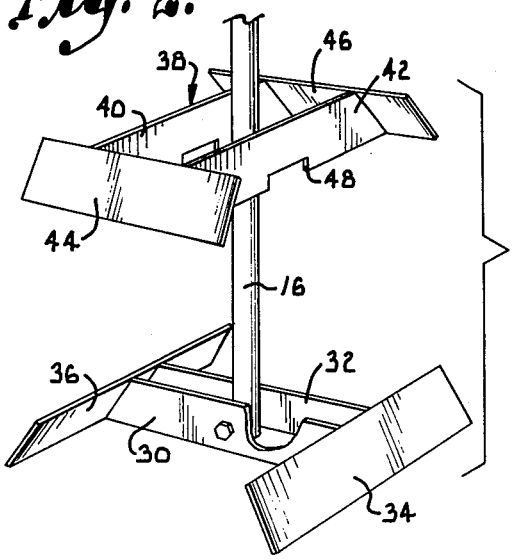
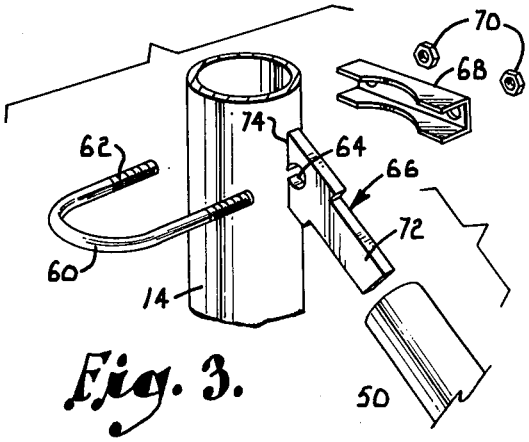
Fig. 3.
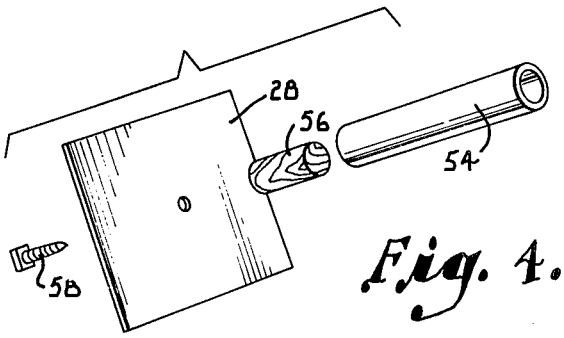
Fig. 4.

FENCE POST CONSTRUCTION

This invention pertains to fence construction, and more particularly, to means for solidly anchoring the main post which bears a substantial part of the load involved in supporting an end or a corner of a fence.

Fences are typically constructed with vertically extending posts which support the horizontally extending fence elements. Very substantial stresses are exerted on the end and corner posts, particularly in wire fences where the wire fence elements are usually stretched and under considerable tension. The end posts and corner posts are normally provided with auxilliary brace members in order to resist the tendency of these main posts to become loosened or pulled from their installed positions under the influence of the loads which are applied to them.

A variety of anchoring and bracing devices have heretofore been suggested for this general purpose. Some of these devices have been more successful than others. However, none of the proposals heretofore suggested, insofar as applicant is aware, has been broadly successful in eliminating the problem associated with maintaining the general stability of main fence posts under the loads encountered in usual fence constructions.

One such suggestion is set forth in U.S. Pat. No. 4,349,181 to Asher and Conway. The patentees propose to enhance main fence post stability by installing a dead man on the lower end of the main post and a pressure plate on the lower end of a brace. The brace is attached to the post in usual fashion and also by an intermediate rigid member extending between the post and the brace. While the teachings of this patent represent an improvement over more conventional constructions, the proposals appear to be deficient in failing to recognize and provide for means to effectively transfer the forces on the main post into the relatively stable soil adjacent the post assembly which is undisturbed during fence construction. Further, the patent teaches the placement of the brace pressure plate in a region of the soil which is subject to freezing and thawing conditions, rendering the soil in this region highly unreliable for load bearing purposes. The dead man suggested in the patent can serve only to prevent the post from being lifted through the soil and cannot assist the brace in transferring any of the horizontal load component into the ground.

Accordingly, it is a principal object of the present invention to provide improved fence post and brace construction capable of effectively transferring the substantial forces from fence tension members to the adjacent soil to insure the stability of the post installation.

It is another very important object of the present invention to provide a unique earth anchor for use in conjunction with a main post which anchor is especially designed for transferring the lateral forces on the post to the relatively undisturbed soil region adjacent the post hole.

In the accomplishment of the foregoing object, it is a further object of the invention to provide angled vanes or pressure plates on the dead man or earth anchor so that the latter not only resists forces tending to pull the post upwardly, but also transfers the lateral component of the force on the post to the closely adjacent relatively undisturbed soil region.

A further important object of the present invention is to provide a fence post and brace assembly wherein the pressure plate through which the forces on the post from the fence are transmitted into the soil are positioned at locations not subject to the deleterious effects of freezing and thawing.

Still another very important object of this invention is to provide components for fence post and brace construction capable of achieving the foregoing objects and advantages, yet which are of relatively light weight and which may be readily fabricated by mass production techniques and which are suitable for convenient packaging for shipment, all to effect substantial economies over items heretofore available for this general purpose.

These and other important aims and objectives of the present invention will be further explained or will become obvious from the following description and explanation of the drawing, wherein:

FIG. 1 is a fragmentary side elevational view on a reduced scale of a fence showing components embodying the principles of this invention, parts being broken away and shown in cross-section to reveal details of construction;

FIG. 2 is a partially exploded, perspective view of a dead man or earth anchor embodying the principles of the invention, the main post appearing fragmentally and parts being broken away to reveal details of construction;

FIG. 3 is an enlarged, fragmentary exploded perspective view of the connection for the brace with the main post; and FIG. 4 is a view similar to FIG. 3 but illustrating the connection of the foot or pressure plate to the brace.

A fence anchor assembly embodying the principles of this invention is broadly designated by the reference numeral 10. Assembly 10 includes a main post 12 which may comprise an upper tubular section 14 and a lower section 16 telescoped into section 14 and secured by a bolt 18 as illustrated clearly in FIG. 1 of the drawing. Main post 12 is adapted to be installed at the end or corner of a fence in order to support the forces exerted by the horizontally extending fence wires 20. The forces exerted by wires 20 are, of course, very substantial. A brace 22 is required to support main post 12 to resist the forces applied by wires 20 to the post.

Post 12 is installed in an upright position in a post hole 24 extending vertically into the soil beneath the surface thereof to a depth well below the frost line. The frost line may be generally defined as the lower limit in the soil of freezing and thawing conditions in the particular region involved. The lowermost end of brace 22 is also installed in an excavation 26 which extends vertically into the soil to a sufficient depth that an enlarged pressure plate 28 on brace 22 is situated substantially below the frost line.

The lower section 16 of post 12 is preferably of transversely circular, tubular construction and is bolted proximal its lowermost end between a pair of elongated rigid parallel members or bars 30 and 32 as illustrated best in FIG. 2 of the drawing. The bars 30 and 32 extend laterally from post 12 on each side of the latter and the terminal ends of the bars are secured by welding or the like to a pair of upwardly and inwardly inclined vanes or pressure plates 34 and 36. Vanes 34 and 36 are preferably rectangular in configuration and present substantial surface areas for a purpose to be described hereinafter.

Referring to FIG. 1, it may be seen that the lengths of the transverse plates 36 and 34 are positioned in relatively close proximity to the peripheral side wall of post hole 24 when the assembly is installed in the fence. This enhances the function of the vanes 34 and 36 in transferring the load from post 12 to the region of relatively undisturbed soil adjacent the hole as will be explained in greater detail hereinafter.

The assembly comprising the members 30 and 32 with their associated vanes 34 and 36 pivotally bolted to the lowermost end of post 12 serves as an earth anchor or dead man in the post hole. The vanes 34 and 36 are preferably positioned so that the flat faces of the vanes are in alignment with the general direction of the fence. In those situations where post 12 is to serve as a corner post with forces to be applied to the post by a stretch of the fence extending at right angles to the wires 20, or when the forces on post 12 are expected to be particularly severe, it may be desirable to install a second earth anchor 38 in conjunction with the anchor bolted to the bottom of the post. Anchor 38 comprises a pair of spaced apart, rigid, parallel extending elements 40 and 42 similar to members 30 and 32. Vanes 44 and 46 which may be identical to vanes 34 and 36 are secured to the opposed end of elements 40 and 42 as shown in FIG. 2 of the drawing. The lowermost edge of each element 40 and 42 is provided with an elongated vertically extending notch 48 so that anchor 38 may be superimposed on the lower anchor with the shoulders of the respective notches engaging the upper margins of members 30 and 32 to lock the two earth anchors against relative horizontal movement. The positions of the two superimposed earth anchors when the second anchor 38 is incorporated into the assembly is illustrated clearly in FIG. 1 of the drawing. Obviously, vanes 44 and 46 are inclined upwardly and inwardly in similar fashion to vanes 34 and 36 but the vanes of the upper anchor are oriented in directions rotated approximately 90° therefrom. Thus, the vanes 44 and 46 are in positions to transmit loads to the surrounding soil which loads are substantially normal to the loads to be transmitted by vanes 34 and 36.

Brace 22 is also preferably of hollow tubular construction and comprises an upper element 50 having a lowermost end 52 of reduced cross-sectional diameter and adapted to receive thereon the tubular lower brace element 54 as illustrated in FIG. 1 of the drawing. Element 54 extends into excavation 26 wherein the foot or pressure plate 28 is secured thereto in position extending substantially perpendicular to the longitudinal axis of the brace. A plug 56 may be telescoped into the lowermost end of the lower brace element 54 so that plate 28 can be attached to the plug and to the brace by means of a screw 58.

The uppermost end of brace 22 is preferably attached to post 12 by means of a clamp 60. Clamp 60 includes a U-shaped element 62 having a leg extending through an aperture 64 in a generally T-shaped member 66. Element 62 is retained in encircling relationship around post 12 by a retainer 68 and nuts 70 as will be readily understood by those skilled in the art. Member 66 includes a shank 72 which is telescoped into the open tubular end of upper brace section 50. The member has an angled end edge 74 configured to embrace the outer surface of upper post section 14. It has been found that the outer periphery of aperture 64 should be close enough to edge 74 to permit element 62 to tightly engage the outer surface of the post section. Aperture 64 serves merely to retain member 66 against vertical movement along the post surface so aperture 64 may be close enough to edge 74 to communicate with the edge if desired. This does not appreciably weaken the member against upward or downward shifting movement and only compressive forces are exerted on the member in the installation described. Further, aperture 64 is preferably sufficiently larger than the clamp leg so that the brace pushes face 74 directly against the post surface.

In operation, the various components are installed in the positions illustrated in FIG. 1. The upper earth anchor 38 is, of course, optional dependent upon a magnitude and direction of the forces exerted to be encountered in the fence construction but has been shown in FIG. 1 for illustrative purposes. It is important that the upwardly and inwardly inclined vane 34 be facing in substantial alignment with a direction of the fence. Further, excavation 26 should be dug in general alignment with the fence. Since excavation 26 should extend below the frost line of the region, it may be necessary to dig a small trench 76 so that the elongated rigid brace 22 may have its upper end secured well above the surface of the earth with its lowermost end down into excavation 26 below the frost line.

It is also important that post hole 24 and excavation 26 not be substantially larger than is required for the installation of the respective components and that the soil around the periphery of the hole and excavation be left substantially undisturbed. The ability of such naturally compacted and undisturbed soil to resist compressive forces applied thereto is markedly greater than that of the usual backfill or disturbed soil.

After the components are installed in the positions illustrated in FIG. 1, the holes are backfilled and tamped to the extent reasonably possible. Brace 22 may be adjusted upwardly or downwardly on post 12 as required by the excavation locations and depths. It is desirable that the uppermost end of the brace be as high as reasonably possible above the surface of the ground to minimize the internal moment within the main post and to utilize the highly stable soil near the bottom of the main post hole for resisting a portion of the lateral force applied by the tensioned wires.

It should be pointed out that the juncture of brace 22 with main post 10 forms the main pivot location for the system of this invention. The main system pivot location for conventional constructions, which utilize rigidly attached components, on the other hand, is below the surface of the ground and usually at some location near the bottom of the main post.

The importance of the main pivot location at the upper end of the brace can be appreciated when one considers the forces which are applied to the system when the fence wires are stretched and attached to the main post. Typically, the uppermost wires of the fence are tensioned first in order to prevent slacking the lower wires by any dislocation of the main post which might occur as a result of the relatively great moment applied to the fence by the tension of the upper wires. In the present construction the force on the main post reaches its maximum upon the tensioning of the last of the wires located above the system pivot point proximal the upper end of the brace. The upper end of the brace 22 forms the pivot for the entire assembly in a broad sense. It will be recognized, however, that the actual connection of member 64 with its flat end edge 72 held tightly against the outer surface of post 14 is a non-pivoting connection. That is, the end edge 74 embracing the post resists any tendency for the post and brace to pivot relative to one another.

Once the brace plate 28 is fully seated against compacted soil (usually little or no movement of the plate is encountered due to the substantial surface area of the plate which acts to distribute the forces) the forces from such upper wires tends to rotate the main post about the main pivot location and is resisted by the compacted soil against the rear plate 36. The substantially surface area of this plate, together with its inclination upwardly and inwardly, insures that these forces are adequately resisted with substantially no movement of the components. The tensioning of the wires of the fence below the main pivot location tends to diminish the forces acting on plate 36.

Once all of the wires have been installed on the fence, a lateral force which would tend to move the main post in the direction of plate 34 remains. This force is, of course, resisted by plate 34 and by the brace foot 28 to insure the stability of the system. Any upward lifting forces are also resisted by the dead man construction.

Vane 34 is inclined upwardly and inwardly toward the post so that the forces exerted on the vane from the post as a result of the pull of the wires are resisted by a downwardly and inwardly directed force from the soil and are transmitted by the vane pushing on the small amount of intervening soil substantially directly to the undisturbed soil at the wall of the hole. The vane serves to squeeze and compact the small amount of intervening backfill in a manner that very little lateral and vertical movement is possible and the forces are conducted to the closely adjacent undisturbed soil.

Vane 36 on the opposite side of the dead man may serve a similar function, particularly for the forces which are applied on the opposite side of post 12 as heretofore described. Manifestly, dead man 38 serves an identical function and is disposed to resist forces from other directions than those heretofore considered. The function of this structure will be readily apparent to those skilled in the art and need not be further described in detail.

The substantial surface area presented by foot or plate 28 in excavation 26 resists the compressive forces from brace 22 and transfers these forces into the undisturbed soil adjacent the excavation. Hereagain, any backfill between the plate and the undisturbed soil is readily compressed by any tendency of the brace to move so that the compressed backfill bears against the undisturbed soil and resists further translation movement. This contributes materially to a substantially immovable permanent fence post installation capable of resisting the relatively great forces imparted to the post by the tightly stretched fence wires.

The components of the post construction herein described have been selected for the achievement of economies in the fabrication and shipment thereof to the site of end use. Thus, the components are made in sections readily susceptible for shipment in disassembled fashion but which can be quickly and easily installed by ordinary skilled workmen by the use of readily available tools. Post 12 is made of relatively telescoped tubular sections which are not only easily fabricated but which can be provided in a variwety of lengths to accommodate the needs of the user. The dead man or earth anchor can be fastened to the post by a single bolt without detracting from the effectiveness of the functions of the anchor. Hereagain, the anchor is fabricated from commercially available plate material. Brace 22 is also of tubular construction and the sections can be furnished in a variety of lengths as may be required. The components can be quickly installed in the field with clamp 60 adjusted to the most advantageous position on the post. Since the vanes of the earth anchors and pressure plate 28 transfer substantially the entire load of the assembly into the soil, it is not necessary to utilize posts and braces having substantially large cross-sectional diameters to provide substantial surface area to resist translation as has heretofore been conventional. With the construction described herein, virtually no forces are transferred directly from the surface of the main post into the soil. Thus, the consideration in selecting the size of the post components is primarily to provide the strength required for transmitting the forces from the fence to the earth anchor. Similarly, brace 22 need only be of sufficient size to bear the compressive forces from post 12 since the substantially large size of pressure plate 28 will adequately transmit these forces into the soil.

I claim:

1. An assembly for anchoring a fence comprising:

a main post for installation in an upright position extending into a post hole which extends vertically into the ground below the frost line;

a dead man secured to the post below ground level, said dead man including a pair of elongated, horizontally spaced apart, rigid members, each member extending laterally from the post in both directions toward the perimeter of the post hole, a first pressure plate being secured to the ends of said members on one side of the post, a second pressure plate being secured to the opposite ends of said members on the other side of said post, an elongated, rigid element projecting laterally from the post in directions normal to the directions of projection of said members, third and fourth pressure plates secured to corresponding ends of respective elements, each plate being inclined upwardly and inwardly toward the post, and means engaging the element with said members whereby forces from the post are transmitted to the adjacent soil through said four plates so that the resistance to said forces by the undisturbed soil serves to stabilize the post against lateral movement under the influence of said forces.

2. The invention of claim 1, wherein is included a second elongated, rigid element, said elements extending in horizontally spaced apart parallelism, each element being secured to said plates said elements being disposed in overlying relationship across the members, said engaging means including an elongated notch in each element, each notch presenting a pair of spaced apart shoulders, the members fitting between the shoulders of the notches to lock the elements against longitudinal shifting movement relative to the members.

3. An end fence post construction comprising:

a main post for upright installation in a post hole extending below ground level;

a dead man secured to the post for disposition in the hole below said ground level, said dead man including rigid structure extending laterally from the longitudinal post axis and mounting pressure plate means facing inclined upwardly and inwardly toward the post in at least four directions spaced approximately 90° apart;

an elongated, rigid brace having one end thereof secured to the post above the ground, the other end of the post extending into an excavation in the ground at a location spaced from said post; and a rigid enlarged pressure foot secured to said other end of the brace for disposition in the excavation below the ground level for transmitting forces from the brace into the soil proximal said excavation.

4. A method of constructing a principal force bearing fence post assembly said method comprising:

digging a post hole in the soil to a depth below ground level;

inserting into the hole a main upright post having a dead man secured to the lower end thereof and extending laterally therefrom, said dead man having upwardly and inwardly inclined pressure plate means disposed below the ground level and in relatively close proximity to the wall of undisturbed soil defining the periphery of said hole said pressure plate means including plates facing in at least four approximately 90° spaced apart directions, facing one of said pressure plates in the direction of pull of the fence on said main post;

digging an excavation in the ground at a location spaced horizontally from the post and in general alignment with said direction of pull of the fence;

installing an elongated rigid brace having an enlarged pressure foot having a surface perpendicular to the axis of the brace by placing the foot in the excavation below said ground level, and attaching the other end of the brace to the post by a non-pivoting connection at a point well above the ground surface; and backfilling the hole and the excavation.

* * * * *